US005401067A

United States Patent [19]

Kurosaki et al.

[11] Patent Number: 5,401,067

[45] Date of Patent: Mar. 28, 1995

[54] LATCH DEVICE

[75] Inventors: Mutsuo Kurosaki; Katsuhito Kurachi, both of Kanagawa, Japan

[73] Assignee: Nifco, Inc., Kanagawa, Japan

[21] Appl. No.: 74,130

[22] Filed: Jun. 8, 1993

[30] Foreign Application Priority Data

Jun. 10, 1992 [JP] Japan ..... 4-150268
Jun. 10, 1992 [JP] Japan ..... 4-150269

[51] Int. Cl.[6] ..... E05C 5/00

[52] U.S. Cl. ..... 292/63; 292/71; 292/DIG. 4

[58] Field of Search ..... 292/63, 64, 71, DIG. 4, 292/341.17

[56] References Cited

U.S. PATENT DOCUMENTS 2,671,928 3/1954 Bright ..... 292/DIG. 4 X
2,868,577 1/1959 Zingone ..... 292/DIG. 4 X
4,702,506 10/1987 Iimura ..... 292/DIG. 4 X
4,792,165 12/1988 Nishimura ..... 292/DIG. 4 X
4,932,707 6/1990 Ekstran ..... 292/341.17
5,292,158 3/1994 Kurosaki ..... 292/DIG. 4 X

FOREIGN PATENT DOCUMENTS 3-110278 5/1991 Japan .
4-64677 2/1992 Japan .
4-209279 7/1992 Japan .
4-213680 8/1992 Japan .

*Primary Examiner*—Rodney M. Lindsey
*Attorney, Agent, or Firm*—Flehr, Hohbach, Test, Albritton & Herbert

[57] ABSTRACT

A latch device includes a latch body provided in a housing so as to be movable in an inserted direction in which the latch body is inserted into the housing, and in a withdrawn direction in which the latch body is withdrawn from the housing, and being continuously urged in the withdrawn direction. Further, circulatory cam grooves are also provided in the housing, and a supporting member is inserted into the circulatory cam grooves and circulates and moves in the circulatory cam grooves so as to hold the latch body at an inserted state position and a withdrawn state position.

19 Claims, 16 Drawing Sheets

LATCH DEVICE

BACKGROUND OF THE INVENTION

1. Field of the Invention

The present invention relates to a latch device which moves a latch body to an inserted state position and a withdrawn state position in a housing.

2. Description of the Related Art

FIG. 19 is a perspective view showing a conventional latch device 170. In FIG. 19, the latch device 170 includes a housing 110, and the housing 110 accommodates a latch body 112 which is urged by a compression spring 122 in a direction of being withdrawn from the housing 110. A rectangular frame 116 is formed at one longitudinal end of the housing 110. An opening 114 is provided in an end of the rectangular frame 116, and the latch body 112 is inserted in the opening 114. Unillustrated projections extend from both side surfaces of the housing 110, and a mounting plate of an unillustrated audio apparatus or the like is clamped by the projections and the rectangular frame 116 so as to mount the housing 110 to the mounting plate.

A concave portion 130 is provided a top surface 126 and an unillustrated bottom surface of the latch body 112, respectively. A circulatory cam groove 166 is formed in each of the concave portions 130. Further, a cam 168 including an engaging concave portion 168A is formed in each of the concave portions 130. An outer peripheral surface of the cam 168 forms a part of the circulatory cam groove 166.

In the latch device 170, a tracing member 160 is provided to correspond to the circulatory cam groove 166. The tracing member 160 is provided in a substantially rectangular form. The tracing member 160 horizontally extends from both ends of a supporting portion 161 in the same direction, and distal ends thereof are bent at right angles in a mutually approaching direction so as to form tracing portions 162 and 164. The tracing portion 162 is guided by an outer periphery of the cam 168 which is formed on the top surface of the latch body 112. Further, the tracing portion 164 is guided along an outer periphery of the unillustrated cam 168 which is formed on the reverse surface of the latch body 112.

A pair of arms 146, 148 are provided at an end of the latch body 112 which is opposite to the end thereof which is inserted into the housing 110. The respective distal ends of the arms 146, 148 are separated from each other so that the pair of arms 146, 148 are provided in an enlarged diameter state.

In the latch device 170, an enlarged diameter distal portion 150A of a striker 150 provided at an unillustrated openable cover presses an intermediate portion 147 provided between the arms 146 and 148 so as to push the latch body 112 in an inner direction of the housing 110. Consequently, the arms 146, 148 contact the rectangular frame 116 so that the arms 146, 148 rotate in a mutually approaching direction with hinges 146A, 148A as fulcrums. As a result, the enlarged diameter distal portion 150A of the striker 150 is held by the arms 146, 148, thereby closing the openable cover.

At this time, the tracing portions 162, 164 of the tracing member 160 are guided by the respective outer peripheries of the cams 168 corresponding thereto so as to reach the engaging concave portions 168A. Further, the tracing portions 162, 164 engage the engaging concave portions 168A to prevent the latch body 112 from being withdrawn from the housing 110.

However, in the prior art latch device, the circulatory cam grooves 166 are provided in the latch body 112. Accordingly, it is necessary to provide a thick-walled latch body 112 so as to ensure the strength of a position of the latch body 112 which becomes thinner due to the circulatory cam groove 166. As a result, it is difficult to make the latch body 112 more compact and thinner. Further, there are drawbacks in that the configuration of the latch body 112 is complicated and molding failure easily occurs due to the circulatory cam grooves 166 which are provided in the latch body 112.

In addition, if the circulatory cam grooves 166 are area in the latch body 112, there are thin-walled positions of the latch body 112 due to the circulatory cam grooves 166. Thus, it is impossible to efficiently ensure rigidity of the latch body 112, and it is difficult to efficiently ensure reliable operation of the latch device.

As shown in FIG. 20, there is another well-known conventional latch device used to anchor, for example, the openable cover of an audio apparatus or the like. In the latch device, a latch body 202 is inserted into an opening 200A of a housing 200 which is attached to the audio apparatus or the like. An engaging portion 206 is formed via a hinge portion 204 at an end of the latch body 202 in a withdrawn direction (i.e., in a direction of arrow H in FIG. 20). The engaging portion 206 includes engaging pawls 206A and 206B to hold the openable cover.

Further, in the latch device, a tracing member 210 is accommodated in a concave portion 208 which is provided in the latch body 202, and a rotary shaft 212 of the tracing member 210 is inserted into a through hole 200B of the housing 200. Therefore, when a tracing portion 214 circulates and moves in a circulatory cam groove 218 provided in the latch body 202 as shown in FIG. 21, the tracing member 210 can rotate in a direction perpendicular to the surface of the drawings of FIG. 20 about the rotary shaft 212.

As shown in FIG. 21, the circulatory cam groove 218 is provided in a substantially heart-shaped form, and a projection 216 is provided at an intermediate portion thereof. Further, the circulatory cam groove 218 is positioned such that a groove concave portion 218A and a groove distal end 218B can respectively anchor the tracing portion 214 in an inserted state and a withdrawn state of the latch body 202.

In this case, when the engaging pawl 206B of the engaging portion 206 shown in FIG. 20 is pressed via the unillustrated openable cover in an inserted direction (i.e., in a direction of arrow I in FIG. 21), the latch body 202 is moved in the inserted direction. Accordingly, the tracing portion 214 of the tracing member 210 is moved relatively from the groove concave portion 218A in a direction of arrow J in FIG. 21 via a step portion 220 to a groove top portion 218C. When the pushed-in operation of the latch body 202 is released, the latch body 202 is moved in the withdrawn direction by urging force of the compression coil spring 224 shown in FIG. 20. Thus, the tracing portion 214 is moved in a direction of arrow K, and is moved relatively to the groove distal end 218B via the step portion 226. The latch body 202 is thereby withdrawn from the housing 200 (the state shown by the solid lines in FIG. 20). When the latch body 202 is switched over from the inserted state to the withdrawn state, the hinge portion 204 is deformed by the urging force of the compression coil spring 224 to rotate the engaging portion 206 of the latch body 202 counterclockwise from its horizontal position shown by the imaginary lines in FIG. 20. The holding state of the openable cover is thereby released.

When the latch body 202 in the withdrawn state is pushed in the inserted direction again, the tracing portion 214 is moved in a direction of arrow L from the groove distal end 218B to a groove top portion 218D of the circulatory cam groove 218 via a step portion 228. When overstroke in the pressing operation is canceled, the latch body 202 is moved in the withdrawn direction by the urging force of the compression coil spring 224. Consequently, the tracing portion 214 is moved from the top portion 218D in a direction of arrow M, and is moved to the concave portion 218A via a step portion 230, resulting in a pushed-in state where the latch body 202 is pushed into the housing 200 (see the imaginary lines in FIG. 20). When the latch body 202 is switched over from the withdrawn state to the pushed-in state, the hinge portion 204 is deformed against the urging force of the compression coil spring 224 so as to rotate the engaging portion 206 clockwise from the state shown by the solid lines in FIG. 20. The engaging portion 206 is thereby set in the horizontal state shown by the imaginary lines.

However, in the conventional latch device, the hinge portion 204 is deformed so as to rotate the engaging portion 206 for each pressing operation of the openable cover. Therefore, it is impossible to provide sufficient durability of the hinge portion since the hinge portion is fatigued by each pressing operation. In order to overcome this drawback, there is another latch device in which the engaging portion 206 is coupled with respect to the latch body 202 by a pin, and the engaging portion 206 is rotatable about the pin. However, in this latch device, there are other drawbacks such as the number of component parts is increased due to the pin, and manufacturing process of the latch device is more complicated.

SUMMARY OF THE INVENTION

In view of the facts as set forth above, it is an object of the present invention to provide a latch device which can be formed without molding failure and which can be reliably operated.

Further, it is another object of the present invention to provide a latch device in which sufficient strength of a coupling portion between an engaging portion and the latch body is ensured without an increase in the number of component parts.

A latch device according to the first aspect of the present invention includes a housing, a latch body provided in the housing so as to be movable in an inserted direction in which the latch body is inserted into the housing and in a withdrawn direction in which the latch body is withdrawn from the housing, and being continually urged in the withdrawn direction; circulatory cam grooves provided in the housing; and a supporting member which is inserted into the circulatory cam grooves and circulates and moves in the circulatory cam grooves so as to hold the latch body at an inserted state position and a withdrawn state position.

A latch device according to the second aspect of the present invention further includes an engaging member connected to the latch body via a supporting member, and receiving pressing operating force from a member to be engaged which is engaged with the engaging member so as to transmit the pressing operating force to the latch body.

According to the first aspect of the present invention, the supporting member moves in the circulatory cam grooves by the operation of, for example, engaging with a cover of an audio apparatus or the like. Accordingly, the latch body is in the inserted state so as to maintain a closed state of the cover or the like. If, in this state, the cover or the like is further pressed, the supporting member moves along the circulatory cam grooves. Thereafter, when the pressing of the cover or the like is released, the latch body is moved by the urging force, and is set in the withdrawn state with respect to the housing, resulting in, for example, an opened state of the cover.

Further, since the latch body and the housing are coupled to each other by the tracing member in the present invention, the pressing operating force by the engaged member can be directly transmitted to the housing, resulting in reliable operation of the latch device.

In the latch device according to the present invention, the circulatory cam grooves are provided in an inner surface of the housing as set forth above, and it is not necessary to provide the circulatory cam grooves in the latch body. Accordingly, there is no thin-walled area in the latch body. It is thereby possible to avoid deformation of the latch body during operation of the latch device, and provide reliable operation of the latch device.

Since the latch device of the present invention is provided as set forth above, it is possible to provide a latch device which can be reliably operated and in which the latch body can be reliably formed.

According to the second aspect of the present invention, the supporting member serves as the tracing portion moving in the circulatory cam groove, and functions to support the engaging member on the latch body. As a result, it is not necessary to provide the tracing member and the supporting member separately, and therefore the number of component parts can be reduced.

Further, since it is not necessary to mount the engaging member via the hinge to the latch body, the coupling portion is not fatigued due to the pressing operation by the member to be engaged. Therefore, it is possible to ensure sufficient durability of the coupling portion between the engaging member and the latch body.

Since the latch device of the present invention is provided as set forth above, there is an excellent effect in that it is possible to ensure sufficient strength of the coupling portion between the engaging member and the latch body without increasing the number of component parts.

DESCRIPTION OF THE PREFERRED EMBODIMENTS

Figure 1:
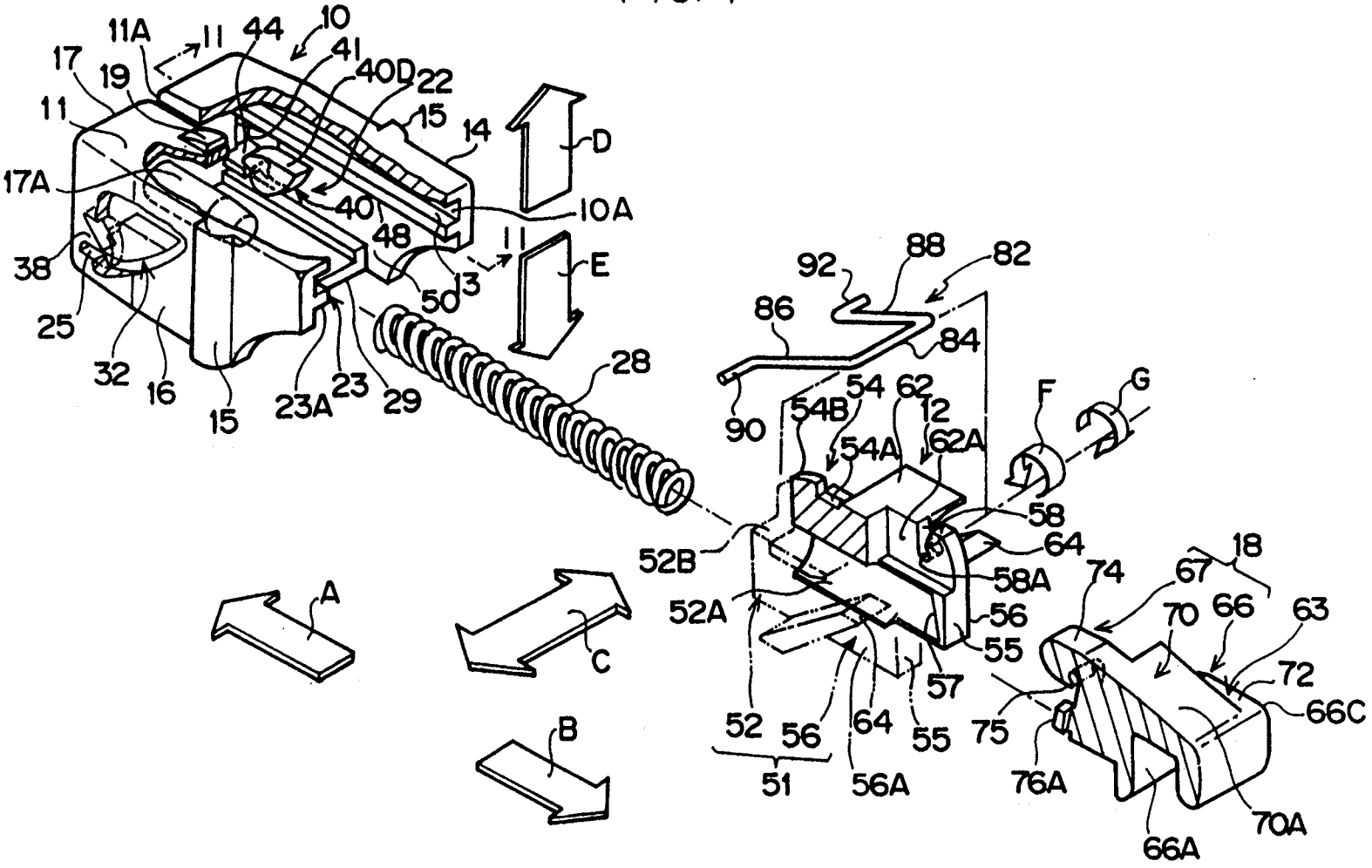
FIG. 1 is an exploded perspective view of one embodiment of a latch device of the present invention.

A description will now be given of a latch device according to one embodiment of the present invention with reference to FIGS. 1 to 18. In the latch device, a holder 18 is mounted to a latch body 12 (see FIG. 10), and the latch body 12 is inserted into an opening 10A which is provided in one end of a housing 10 in a direction of arrow B as shown in FIG. 1. Further, the latch body 12 is provided in the housing 10 so as to be movable in an inserted direction (i.e., in a direction of arrow A in FIG. 1; the direction of arrow A will be referred to as the inserted direction hereinafter) and in a withdrawn direction (i.e., in a direction of arrow B in FIG. 1; the direction of arrow B will be referred to as the withdrawn direction hereinafter).

Figure 2:
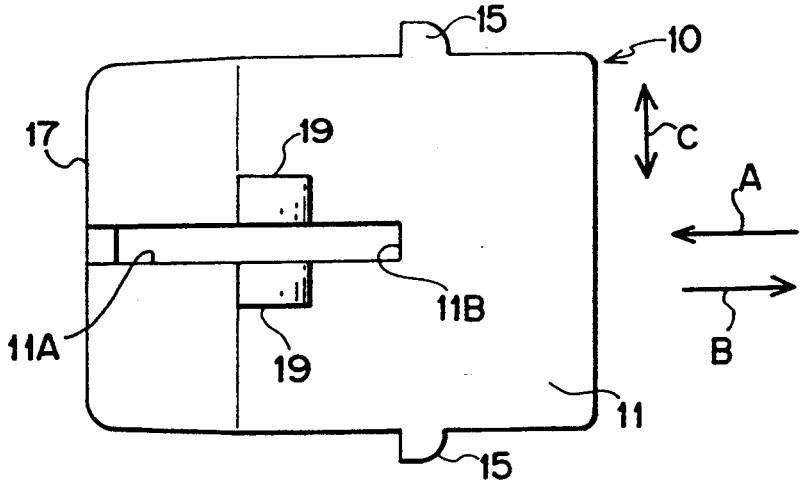
FIG. 2 is a plan view of a housing shown in FIG. 1.
Figure 4:
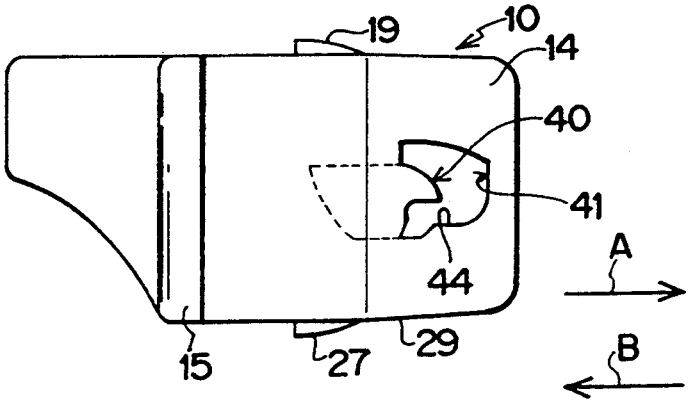
FIG. 4 is a back view of the housing shown in FIG. 1.

The housing 10 is provided in a box-shaped form, and a flange 15 extends from an intermediate portion in the inserted direction on each of outside surfaces of side walls 14, 16 which are provided parallel to each other. A longitudinal direction of the flange 15 extends along a direction perpendicular to the inserted direction. As shown in FIG. 2, a pair of projections 19 are formed on a top surface of an upper wall 11 of the housing 10 at positions closer to the ends of the housing 10 in the inserted direction with respect to positions of the flanges 15. Further, the pair of projections 19 are provided at a predetermined interval in a lateral direction (i.e., in directions of arrow C in FIGS. 1 and 2) of the housing 10. As shown in FIG. 4, a projection 27 is provided on a bottom surface of a bottom wall 29 which is provided at the housing 10, and has a configuration which is symmetrical to the projections 19. When the housing 10 is inserted into a through hole in a member to be mounted of an unillustrated audio apparatus from the side of the inserted direction, the flanges 15, the projection 27 and the pair of projections 19 are anchored at a peripheral edge of the through hole of a wall portion which is provided in the member to be mounted. Consequently, the housing 10 can be mounted to the member to be mounted in a state in which the housing 10 is prevented from moving in the inserted direction and in the withdrawn direction.

As shown in FIG. 2, an elongated hole 11A passes through the upper wall 11 of the housing 10 so as to extend from the end of the latch body 12 in the inserted direction to a withdrawn direction intermediate portion by passing between the pair of projections 19. As shown in FIG. 1, an inner side wall 17 is provided at the end of the housing 10 in the inserted direction, and a cylindrical supporting pin 17A extends toward the withdrawn direction from a substantially intermediate portion on an inner surface of the inner side wall 17. One end of a compression coil spring 28 is wound on the supporting pin 17A. The other end of the compression coil spring 28 contacts an extended portion 76 of the holder 18 as will be described later and a wall surface 57 of the latch body 12 so as to urge the holder 18 in the withdrawn direction. A flat plate 13 projects in a vicinity of the upper wall 11 from an inner surface of the side wall 14. The flat plate 13 extends along the inserted direction in a range from the opening 10A to the inner surface of the inner side wall 17, and projects in a direction perpendicular to the inner surface of the side wall 14. Similarly, a flat plate 23 projects from an inner surface of the side wall 16, as in the inner surface of the side wall 14, so as to be opposed to the flat plate 13.

Figure 11:
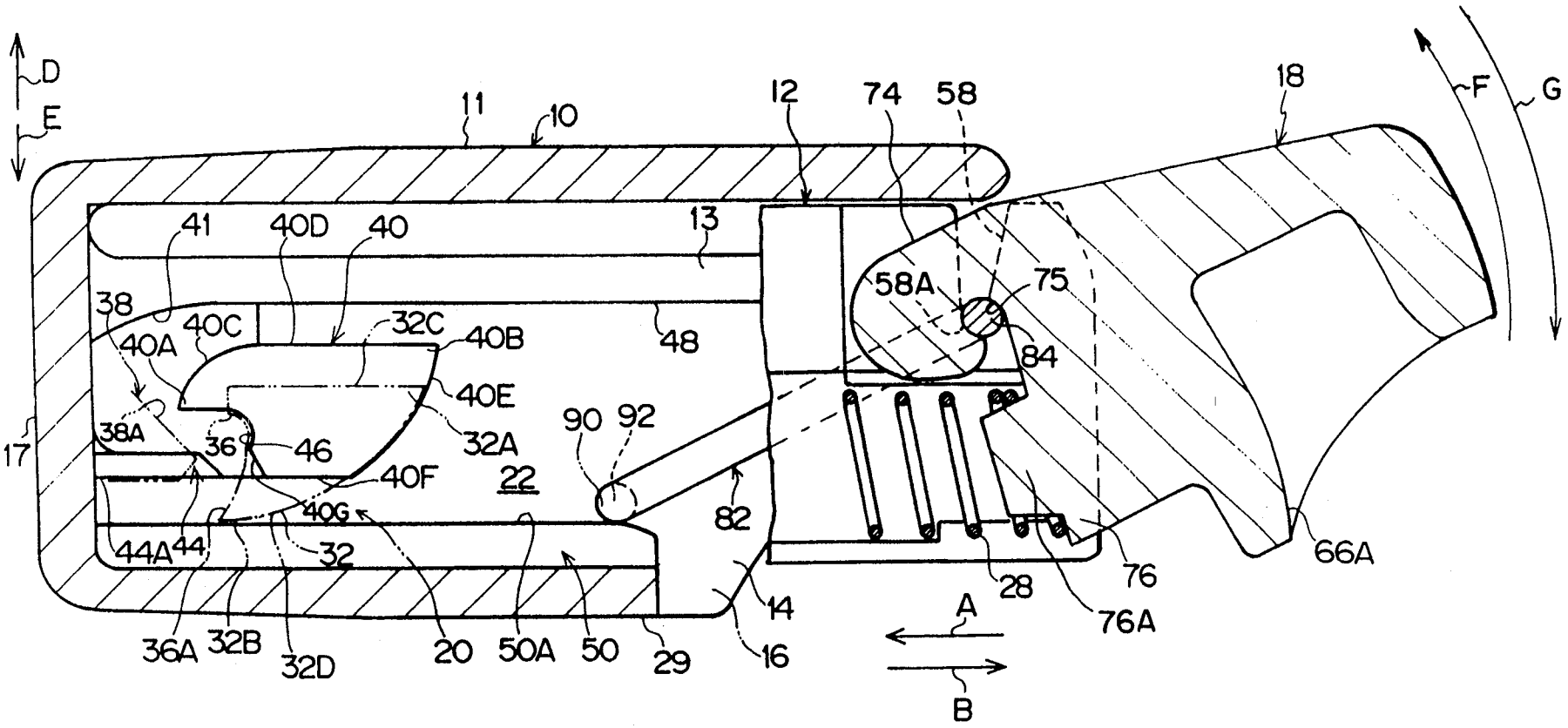
FIG. 11 is a sectional view showing a latch device after assembly, taken along line 11—11 of FIG. 1.

As shown in FIG. 11, a circulatory cam groove 22 is provided on the inner surface of the side wall 14 of the housing 10, and a circulatory cam groove 20 shown by the imaginary lines is provided on the inside of the side wall 16 opposed to the side wall 14. The circulatory cam grooves 20, 22 are provided such that a portion of a supporting member 82 can circulate and move in the circulatory cam grooves 20, 22 when the latch body 12 is inserted and withdrawn.

Figure 19:
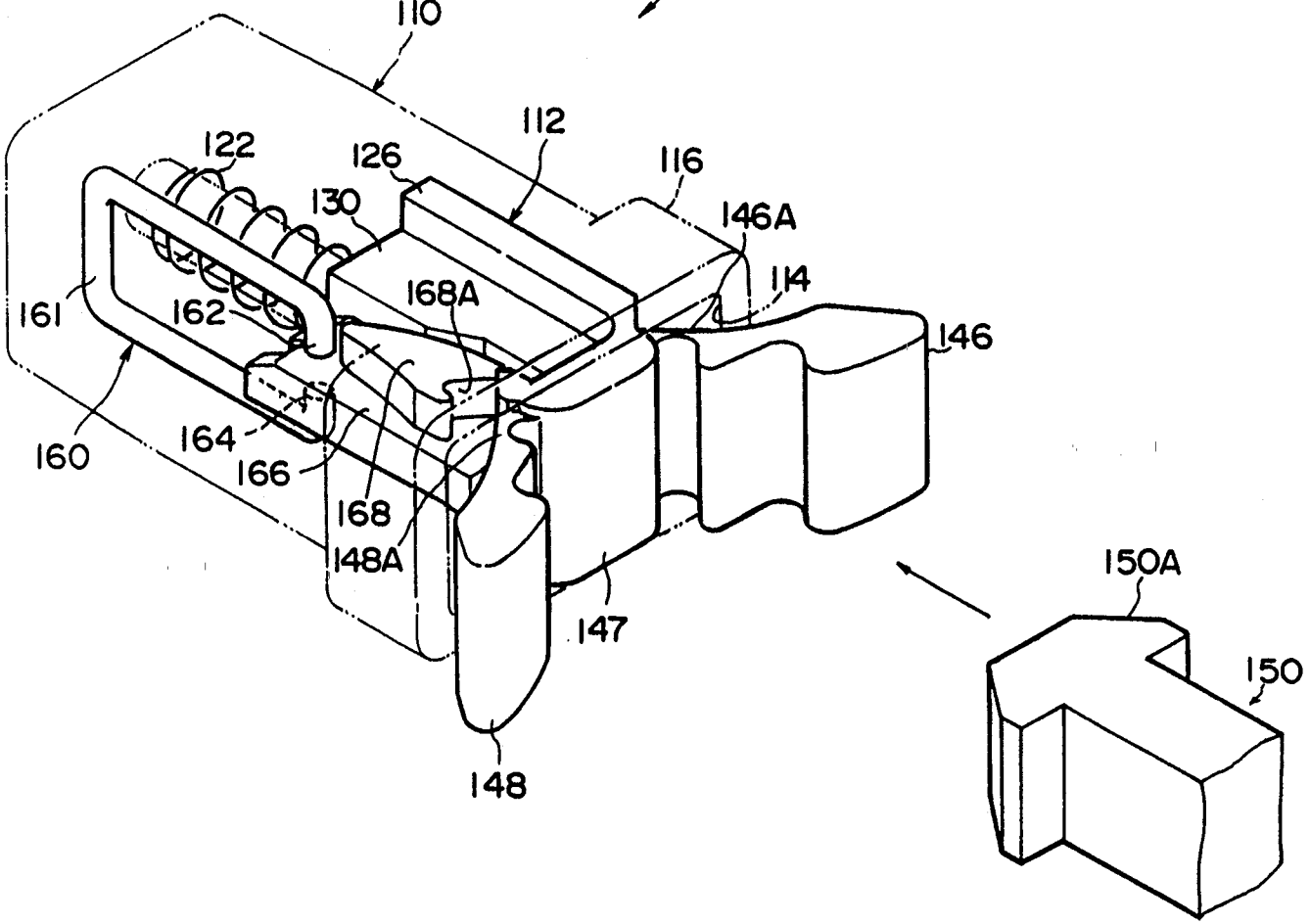
FIG. 19 PRIOR ART
FIG. 19 is a perspective view showing a latch device in the prior art.
Figure 20:
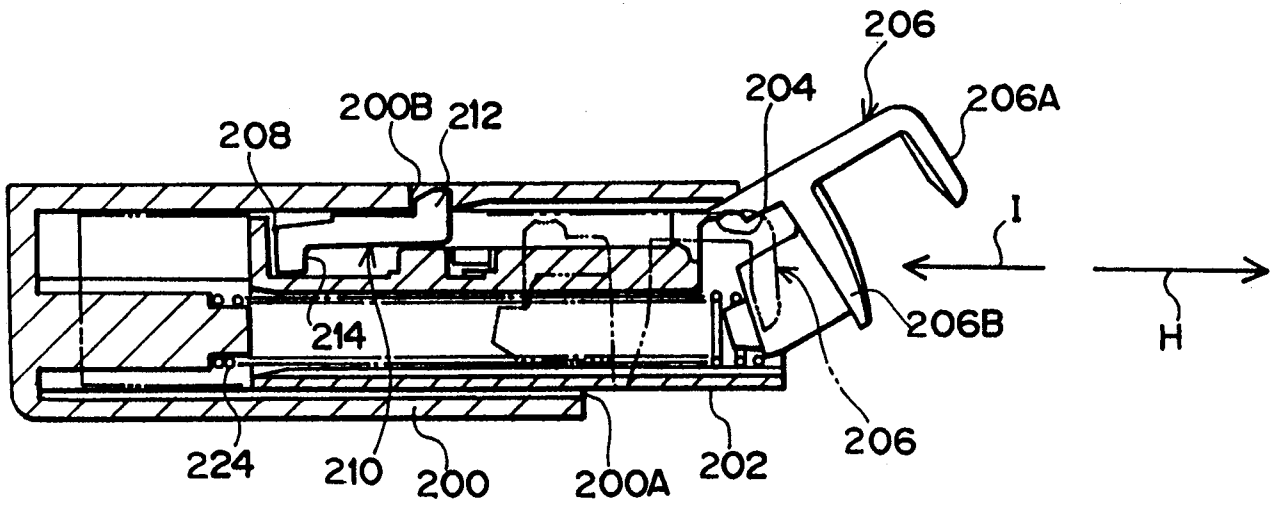
FIG. 20 PRIOR ART
FIG. 20 is a sectional view showing another latch device in the lot art.
Figure 21:
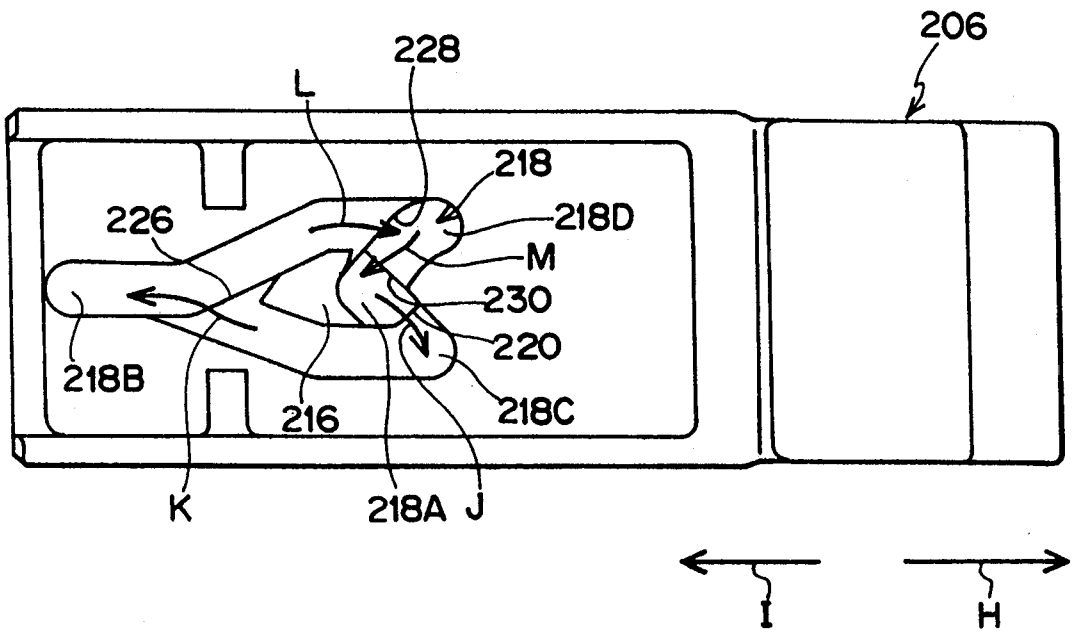
FIG. 21 PRIOR ART
FIG. 21 is a sectional view showing a circulatory cam groove which is formed in a latch body shown in FIG. 20.

The supporting member 82 is made of a rod as shown in FIG. 1, and an axis of the rod is provided in a substantially rectangular form. Further, the supporting member 82 includes a supporting portion 84 disposed along directions of arrow C in FIG. 1, and leg portions 86, 88 extending from both ends of the supporting portion 84 so as to be perpendicular to an axial direction of the supporting portion 84. Distal ends of the leg portions 86 and 88 serve as tracing portions 90 and 92, which are bent at right angles to extend along the directions of arrow C in FIG. 1 in directions of moving away from each other. The tracing portions 90, 92 provided to be inserted into the circulatory cam grooves 20, 22. In the embodiment, as set forth above, the circulatory cam grooves 20, 22 are provided on the respective side walls 14, 16 of the housing 10, and the tracing portions 90, 92 are provided so as to engage the respective circulatory cam grooves 20, 22. Therefore, it is possible to provide a more elongated length L of the supporting portion 84 in the embodiment than that of the supporting portion 161 in the prior art shown in FIG. 19 even if a dimension of the housing 10 in the directions of arrow C in FIG. 1 in the embodiment is the same as that of the prior art shown in FIG. 19. This is because distal ends of the tracing portions 162, 164 are bent in a mutually approaching direction so as to engage the circulatory cam groove 166 of the latch body 112 in the prior art. Hence, in the present embodiment, it is possible to reduce torsional force in the supporting member 82 when the latch device is actuated to a level lower than that in the prior art. Torsional rigidity is thereby maintained in the present embodiment.

Portions of the configurations of the circulatory cam grooves 20, 22, respectively, differ from each other. As shown in FIGS. 1 and 11, a projecting plate portion 50 projects from the inner surface of the side wall 14 so as to contact the bottom wall 29 and extend along the inserted direction parallel to the flat plate 13. A surface of the projecting plate portion 50 facing the upper wall 11 (i.e., a surface on the side of the direction of arrow D in FIG. 11) is defined as a groove wall surface 50A forming a part of the circulatory cam groove 22. Further, a lower surface of the flat plate 13 is defined as a groove wall surface 48 forming a partial wall surface of the circulatory cam groove 22.

Figure 15:
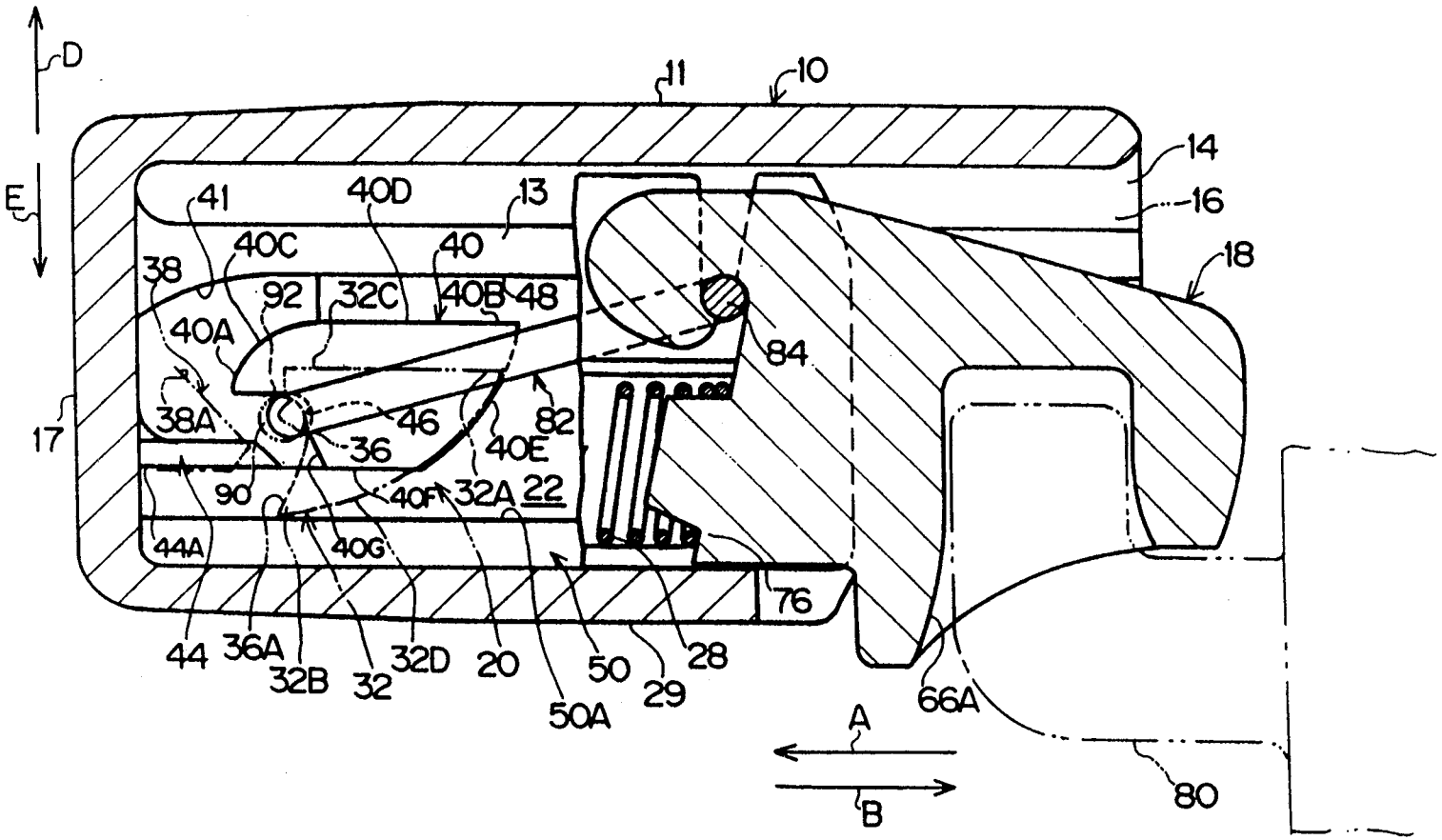
FIG. 15 is another operational view of FIG. 11.

In addition, a cam 40 projects from the inner surface of the side wall 14 at an end of the housing 10 in the inserted direction between the flat plate 13 and the projecting plate portion 50. An outer peripheral surface of the cam 40 forms a part of the circulatory cam groove 22. The cam 40 includes a concave portion 46 which opposes a vicinity of a corner portion which joins the inner side wall 17 with the bottom wall 29. The concave portion 46 serves as a portion into which the tracing portion 92 is inserted for engagement. When the tracing portion 92 and the concave portion 46 are engaged, a state in which the latch body 12 is pushed into the housing 10 is maintained against the urging force in the withdrawn direction of the compression coil spring 28 (see FIG. 1) as shown in FIG. 15.

An angular portion 40A is mounted to an end of the cam 40 in the inserted direction continuously with the concave portion 46 so as to project toward the inner side wall 17. An angular portion 40B is provided at an end of the cam 40 in the withdrawn direction. The cam 40 includes a plane portion 40D facing the flat plate 13, and the plane portion 40D is parallel to the groove wall surface 48. A curved portion 40C, which is formed in a circular arc so as to gradually move apart from the flat plate 13, is mounted to an end of the plane portion 40D in the inserted direction so as to be connected to the angular portion 40A. A plane portion 40F is formed at a lower end surface of the cam 40 facing the projecting plate portion 50 so as to be parallel to the groove wall surface 50A. A curved portion 40E, which is formed in a circular arc so as to gradually move apart from the projecting plate portion 50, is mounted to the side of the plane portion 40F in the withdrawn direction so as to be connected to an angular portion 40B. Further, an end of the plane portion 40F in the inserted direction is defined as a linear slope 40G which abruptly separates from the projecting plate portion 50 so as to be connected to the concave portion 46.

As shown in FIG. 4, a notch 41 is provided in a vicinity of the end of the side wall 14 in the inserted direction in the housing 10, and has a substantially rectangular form as seen from the outside of the side wall 14. As shown in FIG. 1 as well as FIG. 4, a projection 44 projects from the inner surface of the side wall 14 to a direction of the side wall 16 opposed thereto at a peripheral edge in a vicinity of the bottom wall 29 of the notch 41. As shown in FIG. 11, the projection 44 is a flat plate member which is provided parallel to the groove wall surface 50A, and can guide the tracing portion 92 between a lower surface 44A and the groove wall surface 50A along the inserted direction and the withdrawn direction.

An end of the projection 44 on the side of the withdrawn direction is opposed to the linear slope 40G, and, together with the linear slope 40G, forms a passing portion of the tracing portion 92 to the concave portion 46. Further, an upper surface of the projecting portion 44 is opposed to the angular portion 40A, and forms a passing portion of the tracing portion 92 from the concave portion 46.

In addition, a cam 32 extends from the side wall 16 of the housing 10 on the inner side in the inserted direction of the inner surface of the side wall 16 (i.e., on the side of the direction of arrow A in FIG. 11). An outer peripheral surface of the cam 32 forms a part of the circulatory cam groove 20. The cam 32 is provided with a concave portion 36 like the concave portion 46 as shown by the imaginary lines in FIG. 11, and the concave portion 36 serves as a portion to engage the tracing portion 90. When the tracing portion 90 and the concave portion 36 are engaged, the state in which the latch body 12 is pushed into the housing 10 is maintained against the urging force of the compression coil spring 28 (see FIG. 1) in the withdrawn direction, as in the case of the engagement of the tracing portion 92 and the concave portion 46 as described previously.

The cam 32 includes an angular portion 32B extending toward the bottom wall 29, and a passing portion of the tracing portion 90 is defined between the angular portion 32B and the bottom wall 29 of the housing 10. The inner surface of the side wall 16 is not provided with a projection corresponding to the projecting plate portion 50 projecting from the side wall 14. As shown in FIG. 11, the angular portion 32B of the cam 32 is disposed lower than the plane portion 40F of the circulatory cam groove 22. The cam 32 is provided with a concave wall surface 36A to guide the tracing portion 90 to the concave portion 36 in a direction of the upper side of FIG. 11 from the angular portion 32B.

Figure 3:
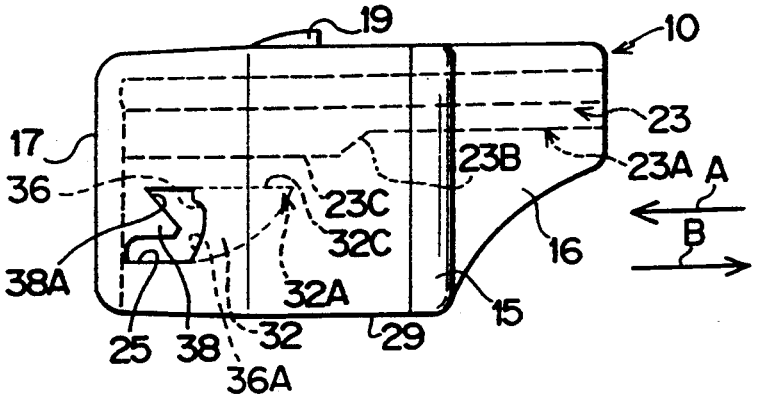
FIG. 3 is a front view of the housing shown in FIG. 1.

As shown in FIG. 3, a slope 23B is formed on a lower surface 23A of the flat plate 23 in a vicinity of the cam 32 and at a position on the side of the withdrawn direction with respect to the cam 32. The slope 23B is inclined so as to become gradually closer to the bottom wall 29 toward the inserted direction. A guide surface 23C is formed on the lower surface 23A of the flat plate 23 in a range from an end of the slope 23B in the inserted direction to the inner surface of the inner side wall 17 so as to be parallel to a wall surface 32C (which is a wall surface of the cam 32 on the upper side of FIG. 3). Thus, it is possible to guide the tracing portion 90 between the guide surface 23C and the wall surface 32C of the cam 32 in the withdrawn direction (i.e., in the direction of arrow B in FIG. 3). The wall surface 32C of the cam 32 is disposed closer to the bottom wall 29 with respect to the plane portion 40D.

An angular portion 32A is provided at an end of the cam 32 in the withdrawn direction. In a range from the angular portion 32A to the angular portion 32B, a convex wall surface 32D is formed in a circular arc so as to gradually approach the bottom wall 29, and can guide the tracing portion 90 to move on the side of a direction of arrow E in FIG. 11. As shown in FIG. 3, a notch 25 is provided in the side wall 16 of the housing 10 in a vicinity of an end of the side wall 16 in the inserted direction, and an unnotched position is defined as a projection 38. An inner surface of the projection 38 extends from the inner surface of the side wall 16 in a direction of the side wall 14. The inner surface of the projection 38 defines a passing route in which the tracing portion 90 reaches the concave portion 36 between the projection 38 and the concave wall surface 36A, and a passing route in which the tracing portion 90 is withdrawn from the concave portion 36 to move in a direction of the inner wall surface 17, respectively. As shown in FIG. 11, the concave portion 36 of the cam 32 is mounted at a position which is slightly deviated on the side of the inserted direction with respect to the concave portion 46 of the cam 40. This is in order to reliably lock the supporting member 82 by the cams 32 and 40 by providing a prerequisite engagement of either combination the tracing portion 90 and the concave portion 36 or the tracing portion 92 and the concave portion 46, while taking parts tolerance of the tracing portions 90, 92 into consideration. Also, the end of the projection 44 in the withdrawn direction extends on the side of the withdrawn direction further than the projection 38 of the side wall 16.

As shown in FIG. 1, the latch body 12 includes a latch body main body 51, and a portion on the side of the inserted direction of the latch body main body 51 serves as a block type base portion 52. Further, a portion on the side of the withdrawn direction of the latch body main body 51 serves as a pair of leg plate portions 56 extending from the base portion 52 so as to be parallel to the withdrawn direction. As set forth above, in the embodiment, the circulatory cam grooves 20, 22 are provided in the housing 10 rather than the latch body 12. Accordingly, since there is no thin-walled portion which is generated due to the circulatory cam grooves, it is possible to sufficiently ensure the strength of the latch body 12. In addition, because the strength is ensured, the latch body 12 can be made thinner than that in the prior art, and processing of the latch body 12 can be facilitated since it is not necessary to form a circulatory cam groove.

Figure 5:
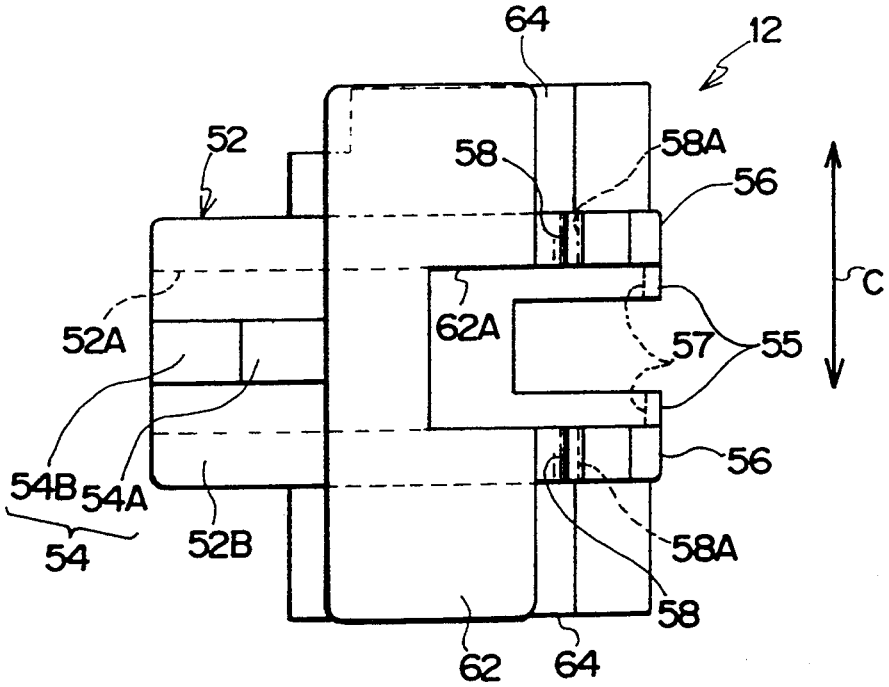
FIG. 5 is a plan view of a latch body shown in FIG. 1.
Figure 6:
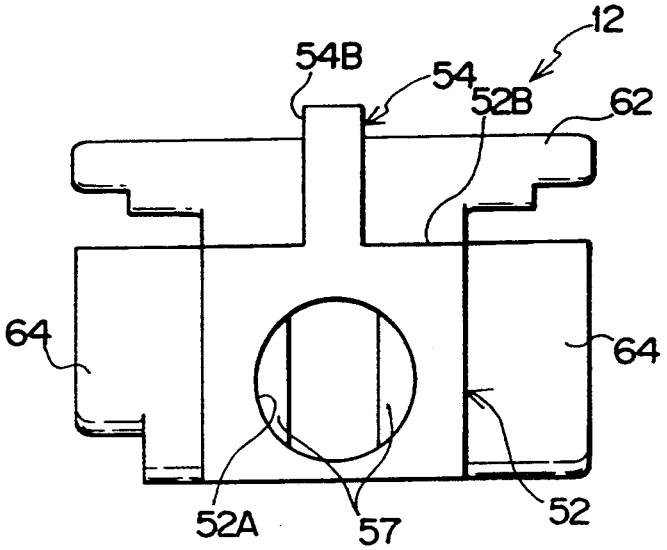
FIG. 6 is a left side view of the latch body shown in FIG. 1.

As shown in FIGS. 5 and 6, a cylindrical through hole 52A passes through the base portion 52 from the end of the base portion 52 in the inserted direction toward the withdrawn direction. Further, as shown in FIG. 1, the through hole 52A extends to a vicinity of an end on the side of the withdrawn direction of a thick-walled portion 55 of the pair of leg plate portions 56, thereby forming the wall surface 57 at the end of the thick-walled portion 55 in the withdrawn direction. The wall surface 57 contacts the end of the compression coil spring 28 in the withdrawn direction, and the latch body 12 is urged by the compression coil spring 28 in the withdrawn direction.

A substantially L-shaped projecting portion 54 extends from an upper wall 52B of the base portion 52. The projecting portion 54 includes a projection 54A and a stopper 54B. The projection 54A projects upward with respect to the upper wall 52B in a vertical direction. The stopper 54B vertically extends upward with respect to the upper wall 52B from an end of the projection 54A in the inserted direction, and is higher than the projection 54A. The stopper 54B is slidably inserted into the elongated hole 11A of the housing 10, and contacts a wall surface 11B (see FIG. 2) in the withdrawn direction of the elongated hole 11A shown in FIG. 2 so as to prevent the latch body 12 from being withdrawn from the housing 10.

A rotation limiting plate 64 extends from each of a pair of side walls 56A of the latch body main body 51 in a vertical direction with respect to each of the side walls 56A. Further, the rotation limiting plates 64 are inclined downward (i.e., in a direction of arrow E) in FIG. 1 toward the inserted direction. The rotation limiting plates 64 are provided in a range from a vicinity of an end of the side wall 56A in the withdrawn direction to a substantially intermediate portion of the side wall 56A in the inserted direction. In addition, the rotation limiting plates 64 contact the leg portions 86, 88 of the supporting member 82 so that the rotation limiting plates 64 limit rotation of the supporting member 82 in a direction of arrow F in FIG. 1.

An inserting plate 62 is mounted on the upper wall 52B of the base portion 52 so as to extend from an end of the projecting portion 54 in the withdrawn direction toward the withdrawn direction, and has a substantially rectangular shape as seen from the direction of the arrow E in FIG. 1. As shown in FIG. 5, a concave portion 62A is provided in the inserting plate 62 on the side of the withdrawn direction. A projecting portion 67 of the holder 18 is fitted into the concave portion 62A, and the holder 18 is inserted between the pair of leg plate portions 56 as will be described hereafter (see FIG. 10).

Both ends of the inserting plate 62 in the directions of arrow C are fitted into spaces between the flat plates 13, 23 and the upper wall 11. When the latch body 12 moves, the inserting plate 62 moves in the spaces along the inserted direction and the withdrawn direction. As shown in FIG. 5, a groove portion 58 is provided in each of top surfaces of the pair of leg plate portions 56. The groove portion 58 has a groove width which gradually becomes narrower from the top surface of the leg plate portion 56 downwardly (in the direction of arrow E in FIG. 1). A fitted portion 58A which is a circular concave portion is formed in each lower end of the groove portion 58, and vicinities of both ends of the supporting portion 84 of the supporting member 82 in the directions of arrow C in FIG. 1 are inserted into the fitted portions 58A. Thereby, the supporting member 82 can rotate between the inserting plate 62 and the rotation limiting plate 64 about an axis of the supporting portion 84.

The holder 18 shown in FIG. 1 is attached to the latch body 12. The holder 18 includes a holder main body 66 which has an engaging concave portion 66A to engage one end of a striker 80 (which is shown by the imaginary lines in FIGS. 12 to 18), and the projecting portion 67 which extends from the holder main body 66 toward the side of the inserted direction so as to be inserted between the pair of leg plate portions 56. The other end of the striker 80 is coupled with the openable cover of the unillustrated audio apparatus or the like.

Figure 8:
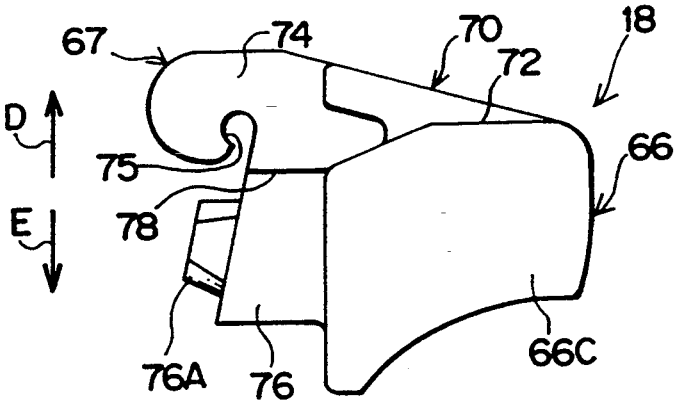
FIG. 8 is a front view of the holder shown in FIG. 1.

As shown in FIG. 8, the projecting portion 67 includes an engaging portion 74 which is hook-shaped as seen from the side of the directions of arrow C in FIG. 1, and an extending plate 76 which extends downwardly from a lower end of the engaging portion 74. The extending plate 76 is thinner than the engaging portion 74 so as to be insertable between the pair of thick-walled portions 55. A step portion 78 serves as a boundary between the engaging portion 74 and the extending plate 76. In the holder 18, when the extending portion 67 is fitted between the pair of leg plate portions 56, the step portion 78 contacts an upper surface of the thick-walled portion 55 of the leg plate portion 56 shown in FIG. 1. Concurrently, the holder 18 is prevented from moving in the directions of arrow C in FIG. 1 with respect to the latch body 12.

Figure 7:
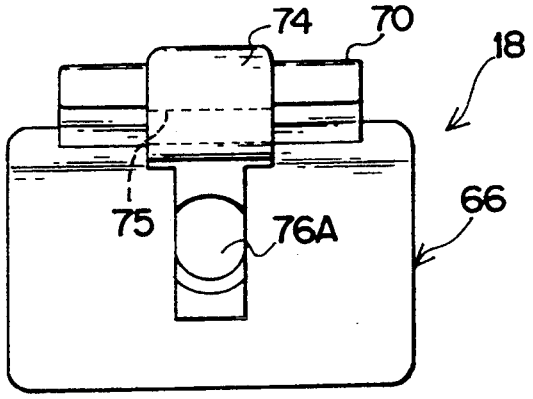
FIG. 7 is a left side view of a holder shown in FIG. 1.

As shown in FIG. 7, an elongated groove portion 75 is provided in the engaging portion 74 so as to have substantially the same diameter as that of the supporting portion 84 of the supporting member 82. The groove portion 75 passes through the engaging portion 74 along the directions of arrow C in FIG. 1. As shown in FIG. 8, the groove portion 75 on the lower side (i.e., on the side of the direction of arrow E in FIG. 8) serves as an opening portion having a narrow width. A longitudinal intermediate portion of the supporting portion 84 of the supporting member 82 is fitted into the groove portion 75 through the opening portion. Thereby, the holder 18 is rotatable in the directions of arrows F and G in FIG. 1 with respect to the supporting member 82 and the latch body 12. In the embodiment, as set forth above, the supporting member 82 functions to trace the circulatory cam grooves 20, 22, and to couple the holder 18 with the latch body 12. Thus, it is not necessary to provide a tracing member to trace the circulatory cam grooves 20, 22, and a separate member to couple the holder 18 with the latch body 12. The number of component parts can thereby be reduced.

Figure 9:
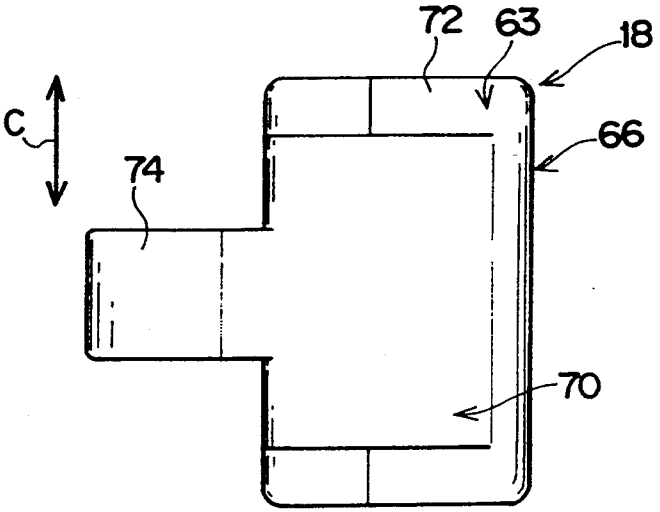
FIG. 9 is a plan view of the holder shown in FIG. 1.
Figure 10:
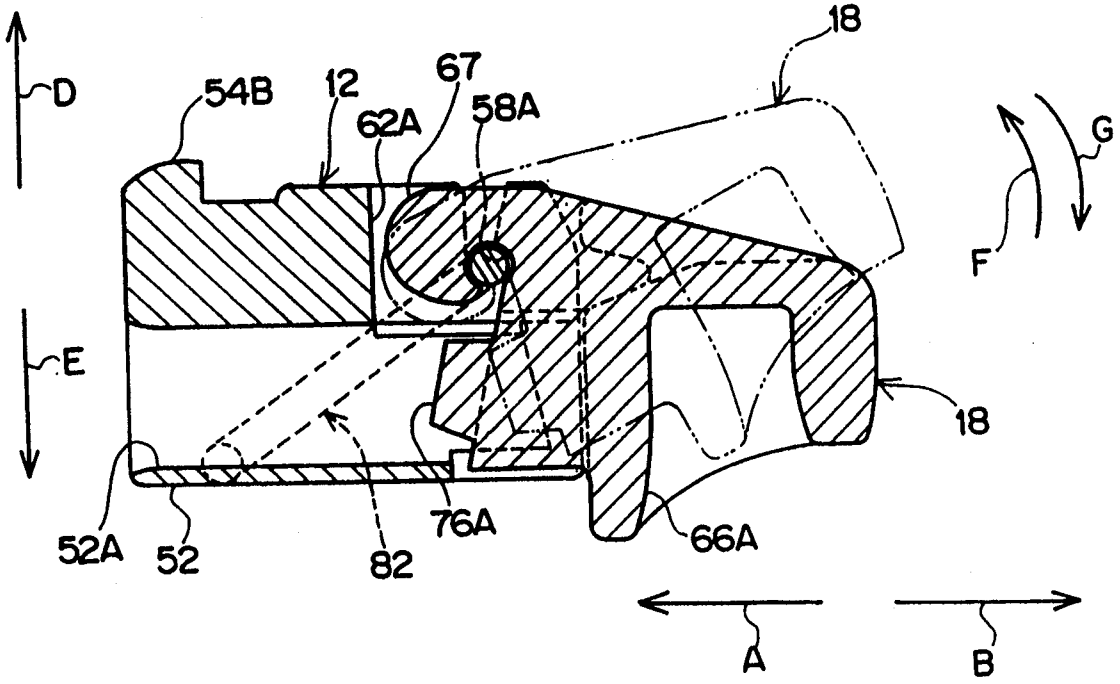
FIG. 10 s a sectional view of the holder and latch body which are coupled by a supporting member, taken along directions of arrow A and arrow B in FIG. 1.

As shown in FIGS. 8 and 9, an upper plate 70 projects from an upper wall 63 of the holder main body 66 so as to extend from an end on the side of the withdrawn direction to an end on the side of the inserted direction. Further, step portions 72 are formed on both ends of the upper plate 70 in the directions of arrow C in FIG. 9. When the holder 18 moves together with the latch body 12 into the housing 10 along the inserted direction and the withdrawn direction, the step portions 72 contact the groove wall surface 48 of the flat plate 13 and the lower surface 23A of the flat plate 23 in the housing 10 so as to be guided.

Further, the upper plate 70 is an inclined surface which is inclined such that an upper surface 70A gradually separates more from the upper wall 63 of the holder 18 along the inserted direction. The upper surface 70A is coplanar with an upper surface of the engaging portion 74.

A supporting pin 76A projects from a side surface of the extending plate 76 on the side of the inserted direction. An end of the compression coil spring 28 shown in FIG. 1 on the side of the withdrawn direction is wound on the supporting pin 76A. As shown in FIG. 11, the end of the compression coil spring 28 in the withdrawn direction contacts the end of the extending portion 76 in the inserted direction. Further, the holder 18 receives rotational force in the direction of arrow F in FIG. 11 about the axis of the supporting portion 84 due to the urging force of the compression coil spring 28. Consequently, when the holder 18 is pressed by the striker 80 in the inserted direction, the holder 18 is rotated in a direction of arrow G against the urging force of the compression coil spring 28 from a position shown by the imaginary lines in FIG. 10 (i.e., a position at which the holder 18 is rotated counterclockwise to the maximum extent by the urging force of the compression coil spring 28). Further, when the holder 18 is further pressed in the inserted direction, the step portion 72 of the holder 18 contacts the groove wall surface 48 of the flat plate 13 and the lower surface 23A of the flat plate 23 so that the holder 18 can be finally moved into the opening 10A of the housing 10.

A description will now be given of the operation of the embodiment with reference to FIGS. 11 to 18.

When the latch device of the embodiment is assembled, the supporting portion 84 of the supporting member 82 is fitted into the fitted portion 58A of the groove portion 58 of the latch body 12. The longitudinal intermediate portion of the supporting portion 84 of the supporting member 82 is fitted into the groove portion 75 of the engaging portion 74 of the holder 18. The holder 18 can thereby be coupled with the latch body 12 via the supporting member 82. In the coupled state, the holder 18 is rotatable together with the supporting member 82 with respect to the latch body 12 in the directions of arrows F and G in FIG. 11.

Subsequently, the latch body 12 is inserted into the housing 10 in which one end of the compression coil spring 28 is wound at the supporting pin 17A. Thereby, the tracing portions 90, 92 of the supporting member 82 can be inserted into the circulatory cam grooves 20, 22, respectively, and are in a state in which their functions as tracing portions can be exhibited. In a state in which the latch body 12 is inserted, the other end of the compression coil spring 28 is wound at the supporting pin 76A of the holder 18. Also, the other end of the compression coil spring 28 contacts the groove wall surface 57 of the latch body 12 so that the latch body 12 is urged in the withdrawn direction by the urging force of the compression coil spring 28. In addition, in the state in which the latch body 12 is inserted, the stopper 54B of the latch body 12 shown in FIG. 1 is inserted into the elongated hole 11A of the housing 10 shown in FIG. 2. Accordingly, it is possible to prevent the latch body 12 from being withdrawn from the housing 10 by the stopper 54B contacting the wall surface 11B of the elongated hole 11A.

In the assembly of the latch device according to the embodiment, as set forth above, the holder 18 may be attached to the latch body 12 via the supporting member 82, and the stopper 54B may be inserted into the elongated hole 11A. This simple operation allows the tracing portions 90, 92 of the supporting member 82 to be inserted into the circulatory cam grooves 20, 22, and allows the tracing portions 90, 92 to exhibit their functions as tracing portions. Thus, an operation to assemble the tracing portions in the housing becomes unnecessary, resulting in easy assembling operation.

The latch device assembled as set forth above is mounted via the housing 10 to the member to be mounted of the unillustrated audio apparatus or the like.

Figure 12:
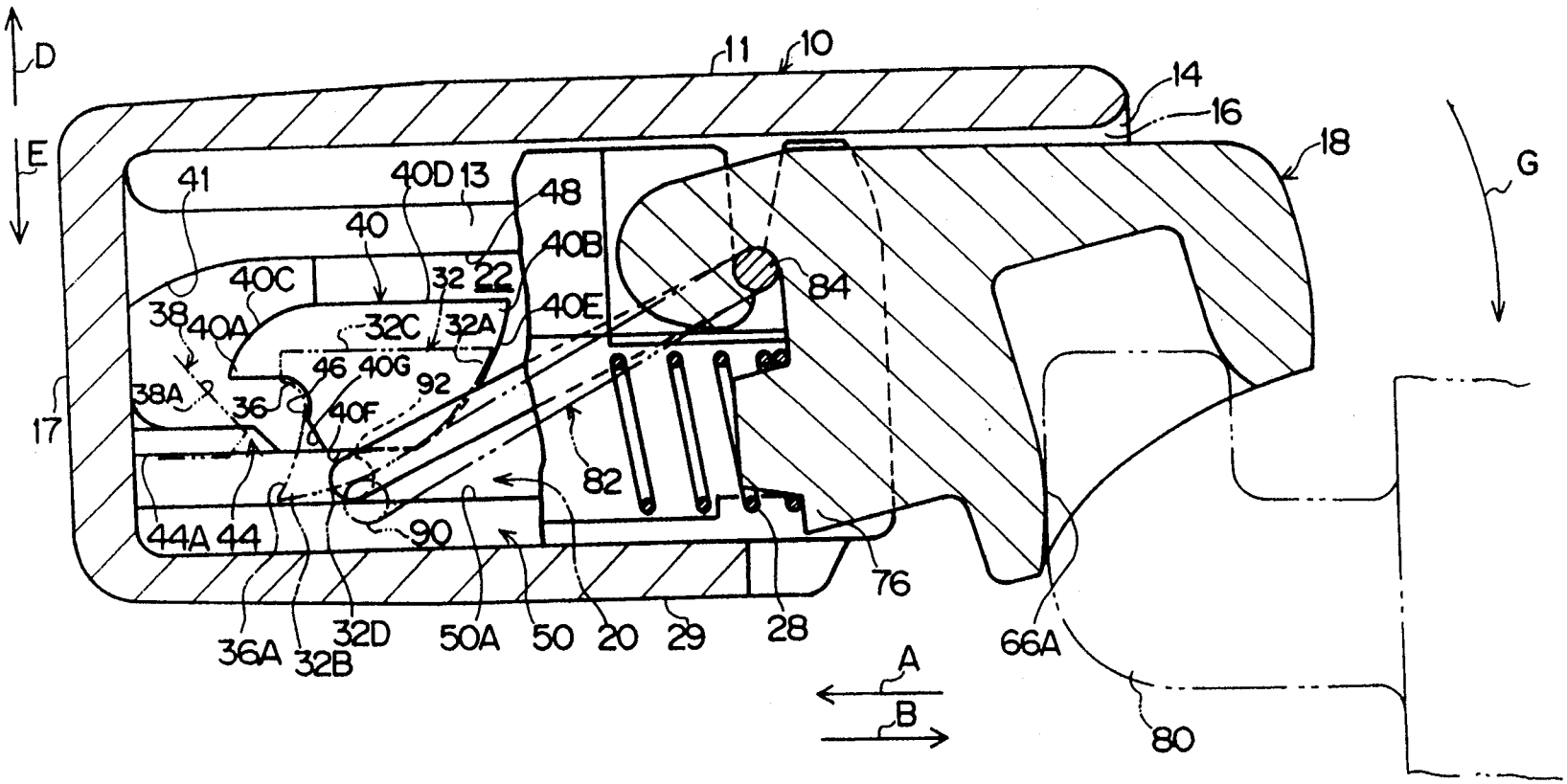
FIG. 12 is an operational view of FIG. 11.

A description will now be given of the operation of the latch device with reference to FIGS. 11 to 18. In the embodiment, the holder 18 moves together with the latch body 12 in the inserted direction and the withdrawn direction in a state in which the supporting member 82 is guided by the circulatory cam grooves 20, 22. In the state shown in FIG. 11 in which the holder 18 is not pressed in the inserted direction by the striker 80 shown in FIG. 12, that is, in an opened state of the unillustrated openable cover, the holder 18 receives the rotational force in the direction of arrow F by the compression coil spring 28. Via the holder 18, the supporting member 82 receives the rotational force in the direction of arrow F about the axis of the supporting portion 84. Therefore, the tracing portion 92 contacts a vicinity of an end of the groove wall surface 50A in the withdrawn direction. When the unillustrated openable cover is pressed in the inserted direction from the state shown in FIG. 11, the striker 80 presses a wall surface of the engaging concave portion 66A in the inserted direction as shown in FIG. 12. Accordingly, while the holder 18 rotates together with the supporting member 82 about the axis of supporting portion 84 in the direction of arrow G, the holder 18 moves together with the latch body 12 in the inserted direction. It is not necessary to utilize the deformation of a hinge portion 104, as in the prior art shown in FIG. 19, to rotate the holder 18. As a result, there is no fatigue in a coupling portion between the holder 18 and the latch body 12.

When the latch body 12 moves, the tracing portion 92 of the supporting member 82 is guided along the groove wall surface 50A on the side of the inserted direction while being pressed onto the groove wall surface 50A of the circulatory cam groove 22. When the supporting member 82 is pressed in the inserted direction so that the tracing portion 92 reaches a position opposed to the plane portion 40F of the cam 40, the tracing portion 92 moves in the inserted direction while being guided between the plane portion 40F and the groove wall surface 50A. On the other hand, the tracing portion 90 is guided by the convex wall surface 32D of the cam 32 of the circulatory cam groove 20 so as to move in the direction of arrow E in FIG. 12. Hence, the tracing portion 90 and the tracing portion 92 gradually deviate in directions of moving apart from each other, which results in the generation of torsional force in the supporting member 82.

Figure 13:
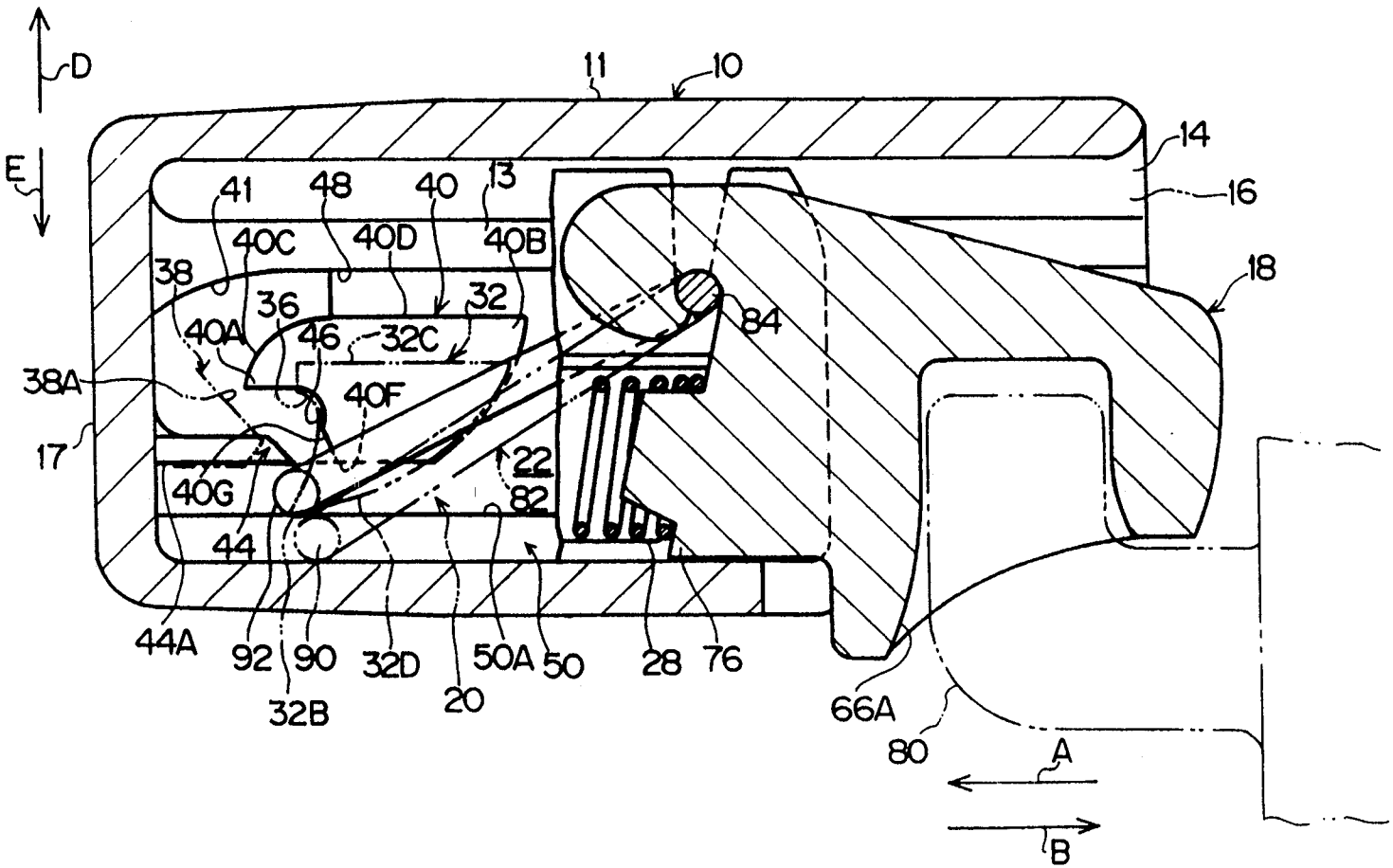
FIG. 13 is another operational view of FIG. 11.

Referring now to FIG. 13, when the tracing portion 90 reaches the angular portion 32B of the cam 32, the maximum deviation is provided between the tracing portion 90 and the tracing portion 92, resulting in the maximum torsional force.

When the openable cover is further pressed in the inserted direction from the state shown in FIG. 13, and the holder 18 is moved via the striker 80 in the inserted direction, the tracing portion 90 moves past the angular portion 32B of the cam 32 in the direction of arrow D by torsional restoring force of the supporting member 82. Subsequently, the tracing portion 90 collides with the projection 38 so as to generate a click sound and cancel deviation between the tracing portions 90 and 92 (see FIG. 14). In this state, the tracing portion 92 already corresponds to the lower surface 44A of the projection 44.

Figure 14:
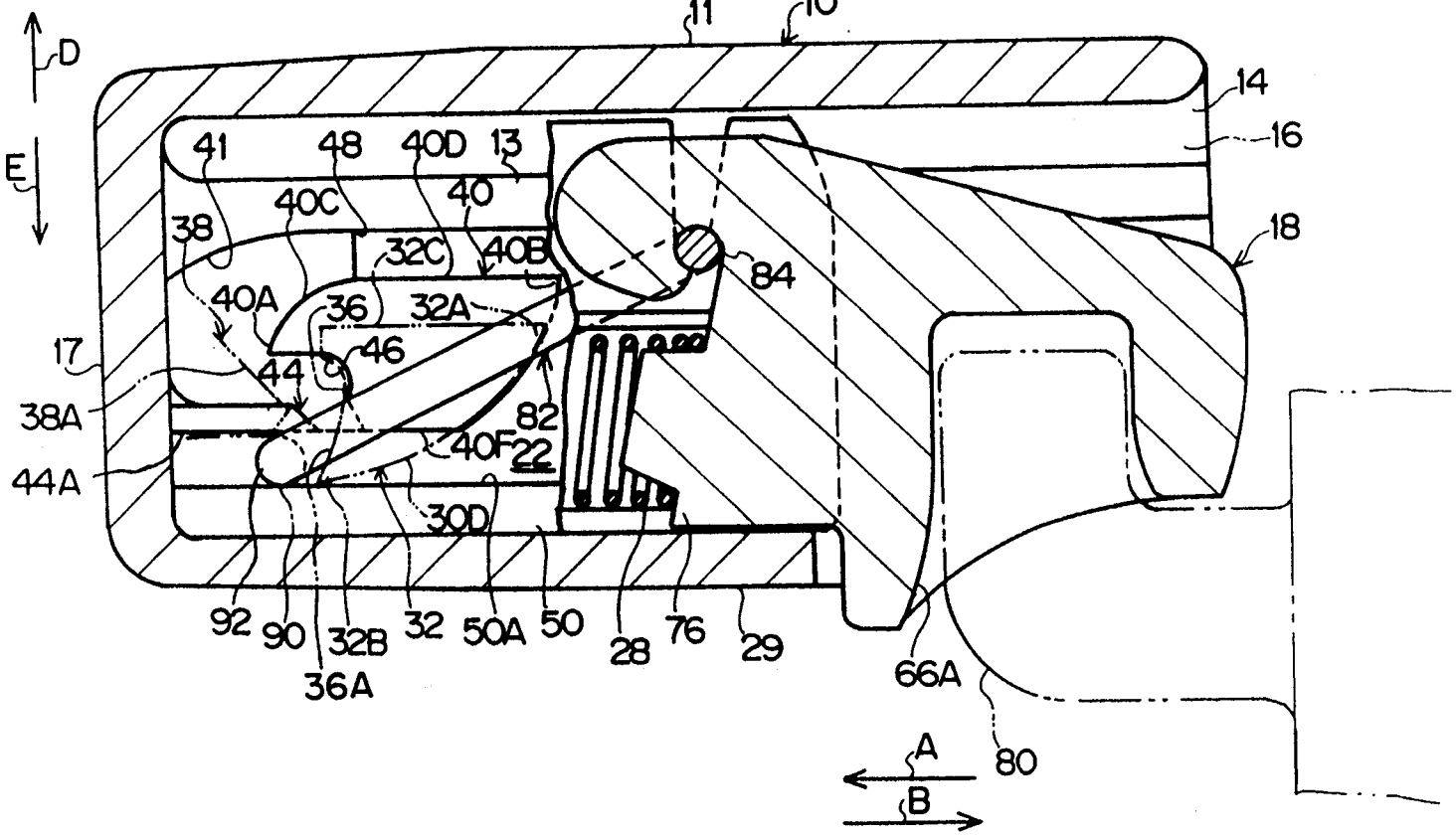
FIG. 14 is another operational view of FIG. 11.

Next, when an overstroke distance generated due to the pressing operation is canceled by the urging force of the compression coil spring 28, the supporting member 82 moves in the direction of arrow B in FIG. 14. At this time, the tracing portion 90 is guided by the concave wall surface 36A of the cam 32 so as to rise. On the other hand, the tracing portion 92 is guided by the lower surface 44A of the circulated cam groove 22 so that torsion is generated in the supporting member 82. When the supporting member 82 is further moved in the direction of arrow B, the tracing portion 92 is separated from the lower surface 44A, and the deviation between the tracing portions 90 and 92 can be canceled because of the restoring force. In the supporting member 82, the tracing portion 90 is guided by the concave wall surface 36A, while the tracing portion 92 is also moved in the direction of arrow D in FIG. 14. Accordingly, the supporting member 82 is locked in a state in which the tracing portion 90 engages the concave portion 36 and the tracing portion 92 engages the concave portion 46, resulting in a closed state of the openable cover (see FIG. 15).

In this case, since the supporting member 82 is prevented from being withdrawn by the two concave portions 36, 46, it is possible to rigidly lock the supporting member 82.

Figure 16:
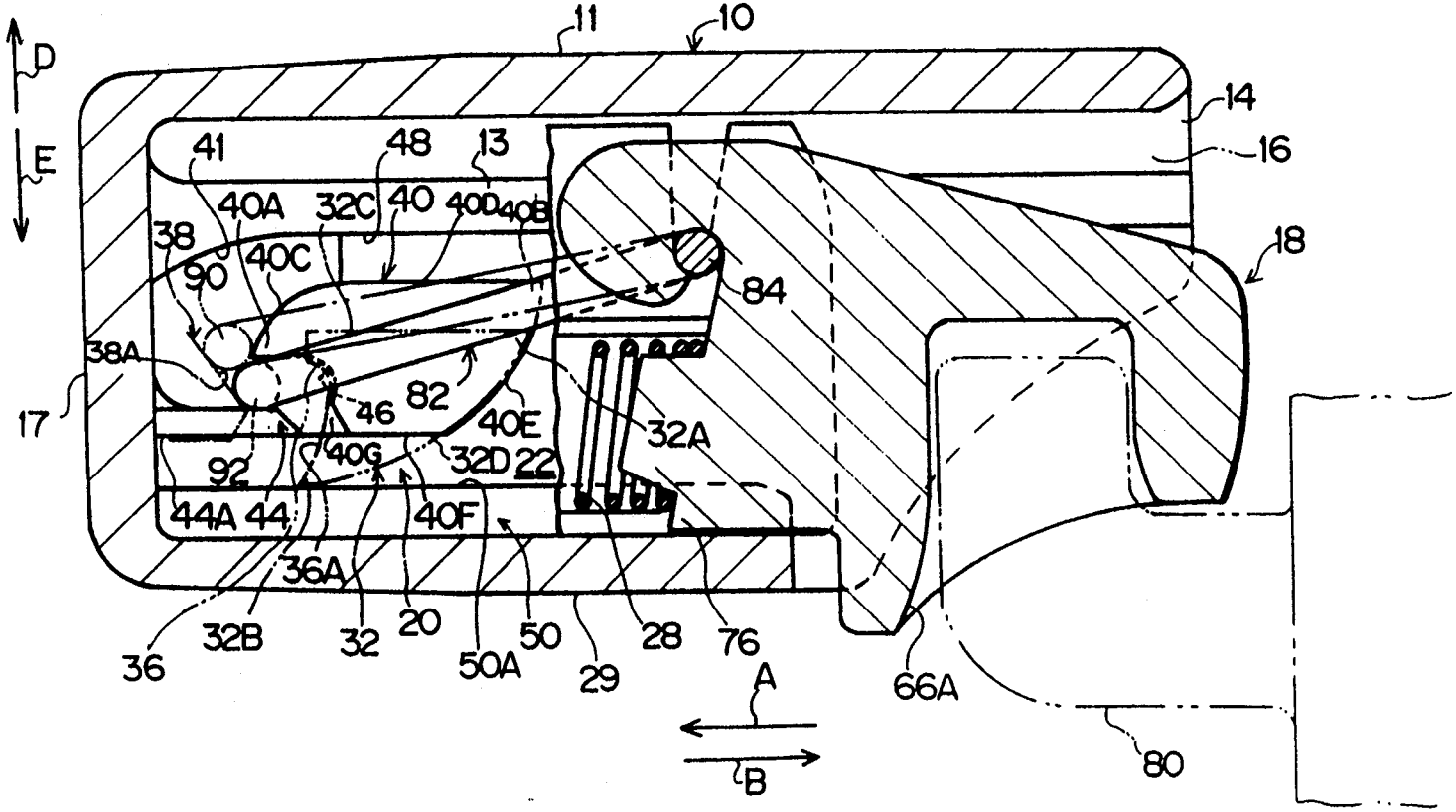
FIG. 16 another operational view of FIG. 11.

In the locked state of the supporting member 82, when the supporting member 82 is further pressed in the inserted direction, as shown in FIG. 16, the tracing portion 92 is withdrawn from the concave portion 46 of the cam 40 and is guided by a lower surface of the angular portion 40A (i.e., a surface opposed to the groove wall surface 50A) so as to move on the inner side in the inserted direction. Concurrently, the tracing portion 90 is guided by the wall surface 38A of the projection 38 to move in the direction of arrow D. The torsion is thereby regenerated in the supporting member 82. The concave portions 36, 46 deviate with respect to a distal end of the lower surface 44A in the circulatory cam groove 22 in the direction of arrow D, and a distal end of the projection 44 is defined as a slope. Hence, the tracing portions 90, 92 do not circulate in the direction of arrow E at a time of the overstroke.

When the supporting member 82 is further moved in the direction of arrow A, the tracing portion 92 can move past the angular portion 40A of the cam 40 by the restoring force of the supporting member 82. Subsequently, the click sound is generated by the tracing portion 92 contacting the lower surface 44A and the deviation between the tracing portions 90 and 92 is canceled, resulting in the state shown in FIG. 17.

Figure 17:
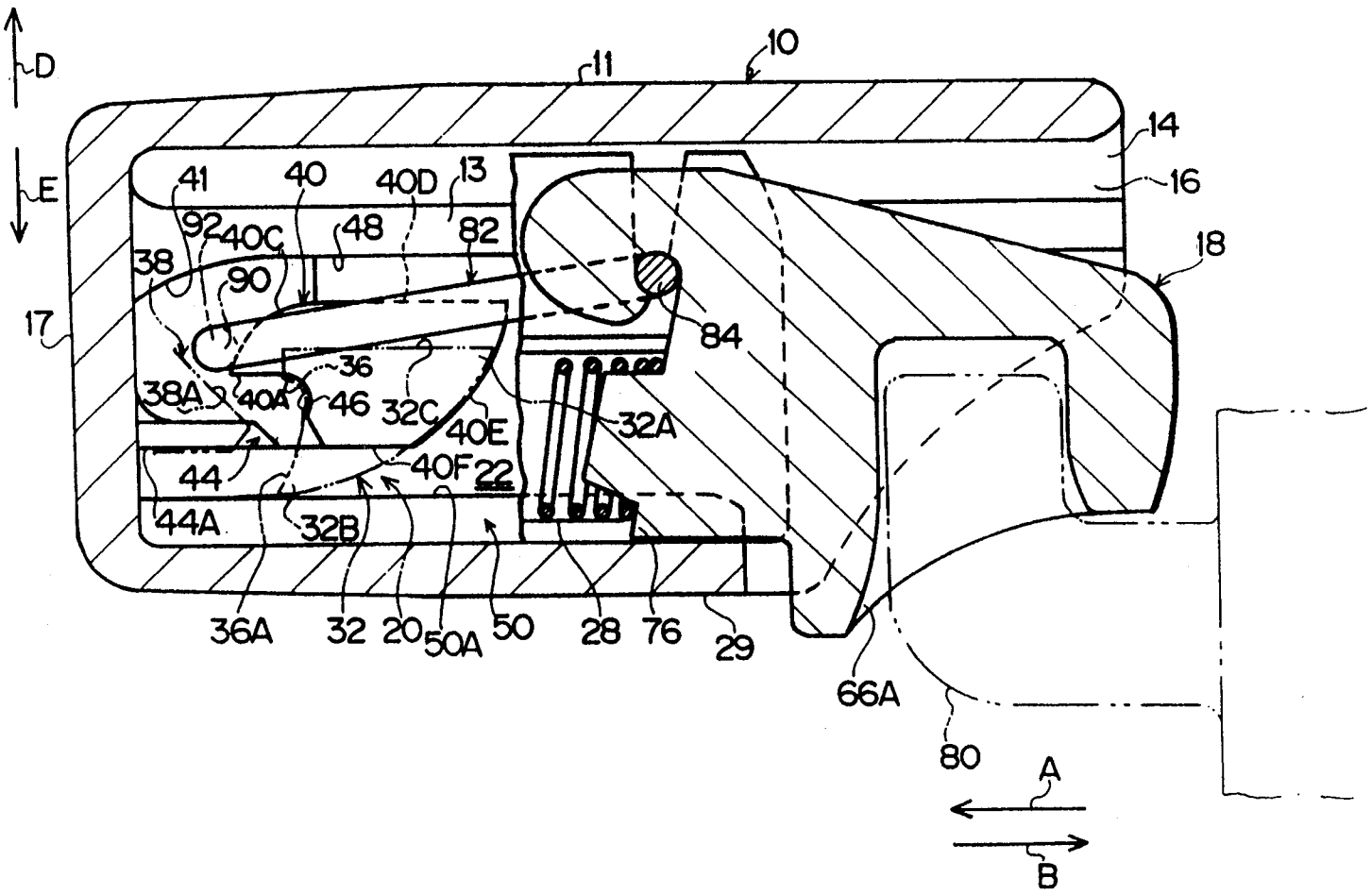
FIG. 17 is another operational view of FIG. 11.
Figure 18:
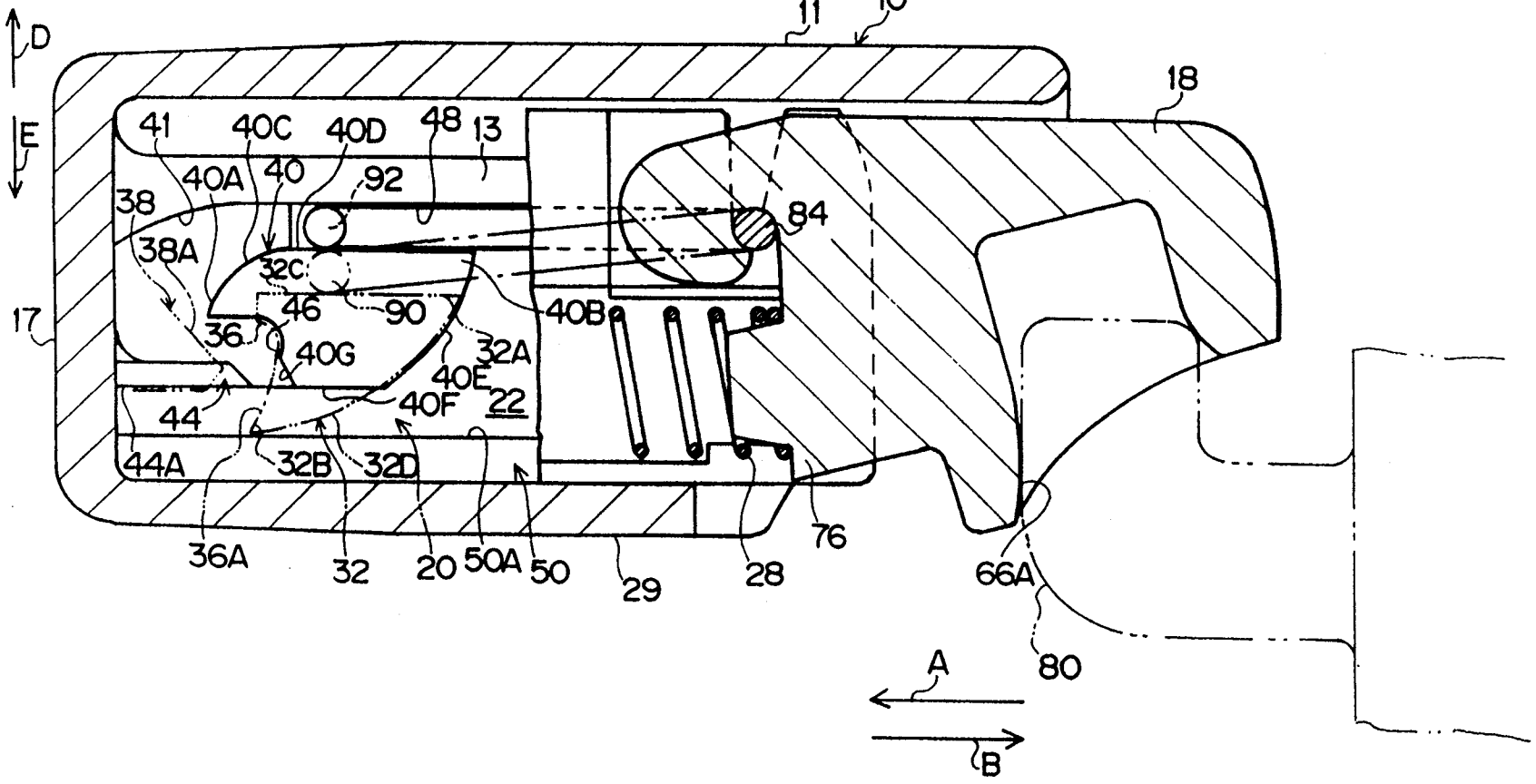
FIG. 18 is another operational view of FIG. 11.

In the state shown in FIG. 17, when the pushing in the direction of arrow A is released, the supporting member 82 receives the urging force of the compression coil spring 28 so that the tracing portion 92 of the supporting member 82 is guided by the curved portion 40C of the cam 40 onto the plane portion 40D, thereby lifting the tracing portion 90 onto the wall surface 32C. Thus, the holder 18 can move together with the latch body 12 in the withdrawn direction. The tracing portion 92 is prevented from moving in a circulating direction and a reverse direction due to interference of the angular portion 40A of the cam 40. As shown in FIG. 18, when the compression coil spring 28 pushes back the supporting member 82 in the direction of arrow B, the tracing portion 90 is guided between the wall surface 32C of the cam 32 and guide surface 23C of the lower surface 23A in the flat plate 23 shown in FIG. 3. Further, the tracing portion 92 is moved in the withdrawn direction while being guided between the wall surface 48 and the plane portion 40D of the cam 40 along the respective wall surfaces, resulting in generation of torsional force in the supporting member 82. When the supporting member 82 is pushed back by the compression coil spring 28 to further move in the direction of arrow B, the deviation between the tracing portions 90 and 92 can be canceled by the restoring force caused by the torsion of the supporting member 82 at the same time that the tracing portion 90 is separated from the angular portion 32A of the cam 32. The supporting member 82 is rotated together with the holder 18 about the supporting portion 84 counterclockwise in FIG. 18 so as to return to the initial state shown in FIG. 11, resulting in the opened state of the openable cover.

When the supporting member 82 is again pushed in on the inner side in the inserted direction, the above operations will be repeated. However, in the initial state of FIG. 11, since the deviation between the tracing portions 90 and 92 is canceled, the tracing portions 90, 92 are never reversely circulated, and are moved in the circulatory cam grooves 20, 22 while being guided by the plane portion 40F and the convex wall surface 32D.

In the embodiment, the circulatory cam grooves 20, 22 are respectively provided on the side walls 16, 14 of the housing 10 rather than side walls of the housing 10 in the directions of arrows D and E. As a result, it is possible to make the entire latch device thinner in the directions of arrows D and E in FIG. 1 as well as make the latch body 12 thinner (i.e., thinner in the directions of arrows D and E).

In the embodiment, the circulatory cam grooves 20, 22 may be provided on the inner surfaces of the housing 10, and do not have to be provided in the latch body 12.

Hence, there is no thin-walled area in the latch body 12. The risk of insufficient rigidity is thereby eliminated, resulting in reliable operation of the latch device.

Further, the latch body 12 can be provided in a simplified configuration since the circulatory cam grooves 20, 22 are not provided in the latch body 12. As a result, it is possible to sufficiently reduce molding failure of the latch body 12.

What is claimed is:

1. A latch device comprising:

a housing;

urging means, provided in said housing, for exerting an urging force;

a latch body provided in said housing so as to be movable in an inserted direction in which said latch body is inserted into said housing, and in a withdrawn direction in which said latch body is withdrawn from said housing, said latch body being continuously urged in said withdrawn direction by said urging means;

circulatory cam grooves provided in said housing;

a supporting member inserted into said circulatory cam grooves and circulating and moving in said circulatory cam grooves so as to hold said latch body at an inserted state position and a withdrawn state position; and an engaging member, connected to said latch body via said supporting member, said engaging member receiving pressing operating force from a member to be engaged, which is engage with said engaging member, so as to transmit said pressing operating force to said latch body.

2. A latch device according to claim 1, wherein said supporting member is a rod-like member.

3. A latch device according to claim 1, wherein said supporting member is rotatably supported by said latch body.

4. A latch device according to claim 1, wherein said circulatory cam grooves are formed in wall portions of said housing which are provided in a direction of a rotational axis of said supporting member.

5. A latch device according to claim 1, wherein said circulatory cam grooves are provided so as to generate torsional force in said supporting member.

6. A latch device according to claim 1, wherein said engaging member includes an engaging portion about which said engaging member rotates for engagement with said supporting member.

7. A latch device according to claim 1, wherein said latch body has supporting member movement limiting means for limiting movement of said supporting member.

8. A latch device according to claim 1 wherein said urging means urges said latch body and said engaging member in said withdrawn direction of said latch body.

9. A latch device according to claim 1, wherein said supporting member is provided in a substantially rectangular configuration, and a substantially intermediate portion of said supporting member is supported by said latch body.

10. A latch device according to claim 1, wherein end portions of said supporting member are inserted into said circulatory cam grooves.

11. A latch device according to claim 1, wherein said latch body has supporting grooves which support said supporting member.

12. A latch device comprising:

a housing;

a latch body provided in said housing so as to be movable in an inserted direction in which said latch body is inserted into said housing, and in a withdrawn direction in which said latch body is withdrawn from said housing, said latch body being continuously urged in said withdrawn direction;

circulatory cam grooves provided in said housing;

a supporting member rotatably supported by said latch body and inserted into said circulatory cam grooves and circulating and moving in said circulatory cam grooves so as to hold said latch body at an inserted state position and a withdrawn state position;

an engaging member engaging a portion of a rotational axis of said supporting member, and provided so as to be rotatable around an engaging portion which engages said supporting member, and said engaging member being connected to said latch body via said supporting member, said engaging member receiving pressing operating force from a member to be engaged, which is engaged with said engaging member, so as to transmit said pressing operating force to said latch body; and urging means for urging said-latch body and said engaging member in said withdrawn direction of said latch body.

13. A latch device according to claim 12, wherein said urging means is a compression coil spring.

14. A latch device according to claim 12, wherein a pair of said circulatory cam grooves is provided so as to correspond to a pair of wall portions of said housing which are provided in a direction of a rotational axis of said rotation of said supporting member.

15. A latch device according to claim 14, wherein said pair of circulatory cam grooves is provided so as to generate torsional force in said supporting member.

16. A latch device according to claim 15, wherein said pair of circulatory cam grooves is formed so as to be mutually asymmetrical.

17. A latch device according to claim 14, wherein said supporting member is a rod-like member formed in a substantially rectangular configuration, a substantially intermediate portion of said supporting member being supported by said latch body, and each end portion of said supporting member being inserted into a corresponding one of said pair of circulatory cam grooves.

18. A latch device according to claim 12, wherein said latch body has supporting grooves which support said supporting member.

19. A latch device according to claim 12, wherein said latch body has a rotation limiting plate which limits movement of said supporting member in a rotating direction.

* * * * *